United States Patent [19]

Kränzle

[11] Patent Number: 4,810,169

[45] Date of Patent: Mar. 7, 1989

[54] PUMP UNIT

[76] Inventor: Josef Kränzle, Rudolf-Diesel-Str. 20, D-7918 Illertissen, Fed. Rep. of Germany

[21] Appl. No.: 60,011

[22] Filed: Jun. 9, 1987

[30] Foreign Application Priority Data

Jun. 9, 1986 [DE] Fed. Rep. of Germany ..... 3619326

[51] Int. Cl.[4] ..... F04B 39/12

[52] U.S. Cl. ..... 417/63; 417/234; 417/313; 239/152; 239/525

[58] Field of Search ..... 417/234, 411, 313, 423 T, 417/63; 137/355.16, 355.17, 355.28; 248/75, 79, 89, 93; 239/152, 525

[56] References Cited

U.S. PATENT DOCUMENTS

| | | | |
|---|---|---|---|
| 1,893,166 | 1/1933 | Fox | 248/75 |
| 3,228,474 | 1/1966 | Huthsing, Jr. | 248/79 |
| 3,885,892 | 5/1975 | Dyer et al. | 417/234 |
| 3,910,722 | 10/1975 | Hochmuth | 417/34 |
| 3,953,710 | 4/1976 | Dyer | 417/411 X |
| 4,070,725 | 1/1978 | Austin et al. | 417/477 X |
| 4,187,058 | 2/1980 | Fish | 417/234 |
| 4,331,883 | 5/1982 | Vitaloni | 417/411 X |
| 4,493,618 | 1/1985 | Buzek et al. | 417/234 |
| 4,621,984 | 11/1986 | Fussell | 417/234 |
| 4,631,006 | 12/1986 | Murray | 417/234 |
| 4,636,146 | 1/1987 | Kranzle et al. | 417/270 |
| 4,694,528 | 9/1987 | Comer et al. | 417/234 X |
| 4,715,787 | 12/1987 | Hung | 417/411 X |

FOREIGN PATENT DOCUMENTS

| | | | |
|---|---|---|---|
| 0447512 | 3/1948 | Canada | 417/234 |
| 2163632 | 3/1986 | United Kingdom | 239/152 |

*Primary Examiner*—William L. Freeh
*Assistant Examiner*—Eugene L. Szczecina, Jr.
*Attorney, Agent, or Firm*—Lowe, Price, LeBlanc, Becker & Shur

[57] ABSTRACT

A pump unit is provided with a housing enclosing a motor and a pump block flanged thereto. The housing closely follows the contours of the motor and the pump block and is provided with external projections for accommodating accessories for use with the pump unit. A handle is integrally formed at an upward projection of the housing, the upward projection serving as an enclosure for a capacitor connected to the motor.

12 Claims, 2 Drawing Sheets

PUMP UNIT

FIELD OF THE INVENTION

This invention relates to a pump unit and, in particular, to a pump unit within a housing is shaped to closely follow the outer contours of the pump unit and is also formed on the outside to conveniently hold assorted accessory elements thereat.

BACKGROUND ART

Electrically driven high pressure pumps are extensively used for cleaning automobiles, machines and the like. A pump block in such a unit is flanged to one end side of an electric drive motor along a horizontal rotational axis. Furthermore, associated to the motor are a connection and switch box and a relatively voluminous capacitor. Such types of high pressure pumps are operated under extraordinarily hard conditions, often resulting in damage to a the connection and switch box and the capacitor. Moreover, for operating such a high-pressure pump, various accessories, such as an electric cable, a hose, a washing pistol and various associated nozzle pipes are needed. When transporting such a pump the cable connected to the connection and switch box is held in the operator's hand in folded form or is attached to the pump by means of a clamp or the like. The other elements usually are not connected to the pump unit and, therefore, they are often lost or mislaid.

U.S. Pat. No. 3,624,150 shows a pump unit supported on wheels and having a cubical housing. A hook projects from one side wall and is arranged for holding a hose.

The West-German Patent Laid Open Publication No. 3401987 discloses a pump unit supported on wheels and having an essentially cubical housing. At one upper edge a holder is attached for supporting a nozzle pipe connected to a washing pistol, the hand grip whereof may be clamped in rubber members attached to a bracket arranged for pulling the pump unit. The housing has openings disposing a control panel and a cover of an inlet for filling-in fuel for a heating device.

The German Patent Laid Open Publication No. 34 00 568 discloses a pump unit supported on wheels and having a cubical housing, one side wall thereof being provided with a rectangular opening which continues in the form of a tube into the interior of the housing. A washing pistol is adapted to be inserted through the opening into the tube.

Brochure Kärcher-Katalog '82 print No. 0182.16500cb1/600 of Alfred Kärcher and GmbH & Co., 7057 Winnenden West-Germany, at page 9 discloses a portable pump unit having an essentially cubical housing and a separate horizontally extending handle, attached to a vertical column, projecting upward from the interior of the pump unit through the housing. The lower side of the handle is rounded and the upper side is provided with a cylindrical recess for loosely accommodating a nozzle pipe attached to a washing pistol. Thus, the handle is a separate element and must be strongly fixed to the unit by means of the vertical column in the interior of the pump unit.

In particular, the cubical form of known pump units makes it difficult to carry the same. Furthermore, the size of the housing is determined by the maximum dimensions in all three orthogonal directions.

SUMMARY OF THE INVENTION

It is an object of the present invention to provide a pump unit having a housing of considerably reduced size.

It is a further object of the present invention to provide a pump unit having a housing which is easy and inexpensive to manufacture and to assemble.

It is a still further object of the present invention to provide a pump unit with a housing provided with means for safely attaching accessories necessary for operating the pump unit.

It is a further object of the present invention to provide a pump unit having a housing designed to facilitate carrying of the pump unit.

In accordance with the invention there is provided a pump unit comprising an electrical motor, a pump block flanged to the motor and provided with connecting means and a housing enclosing said motor and said pump block, wherein the shape of said housing closely follows the outer contours of the pump unit, an upward projecting part of said housing is integrally formed as a horizontally extending handle and said housing is provided with laterally extending projections for accommodating accessories necessary for an operation of said pump unit.

DESCRIPTION OF THE PREFERRED EMBODIMENT

Figure 1:
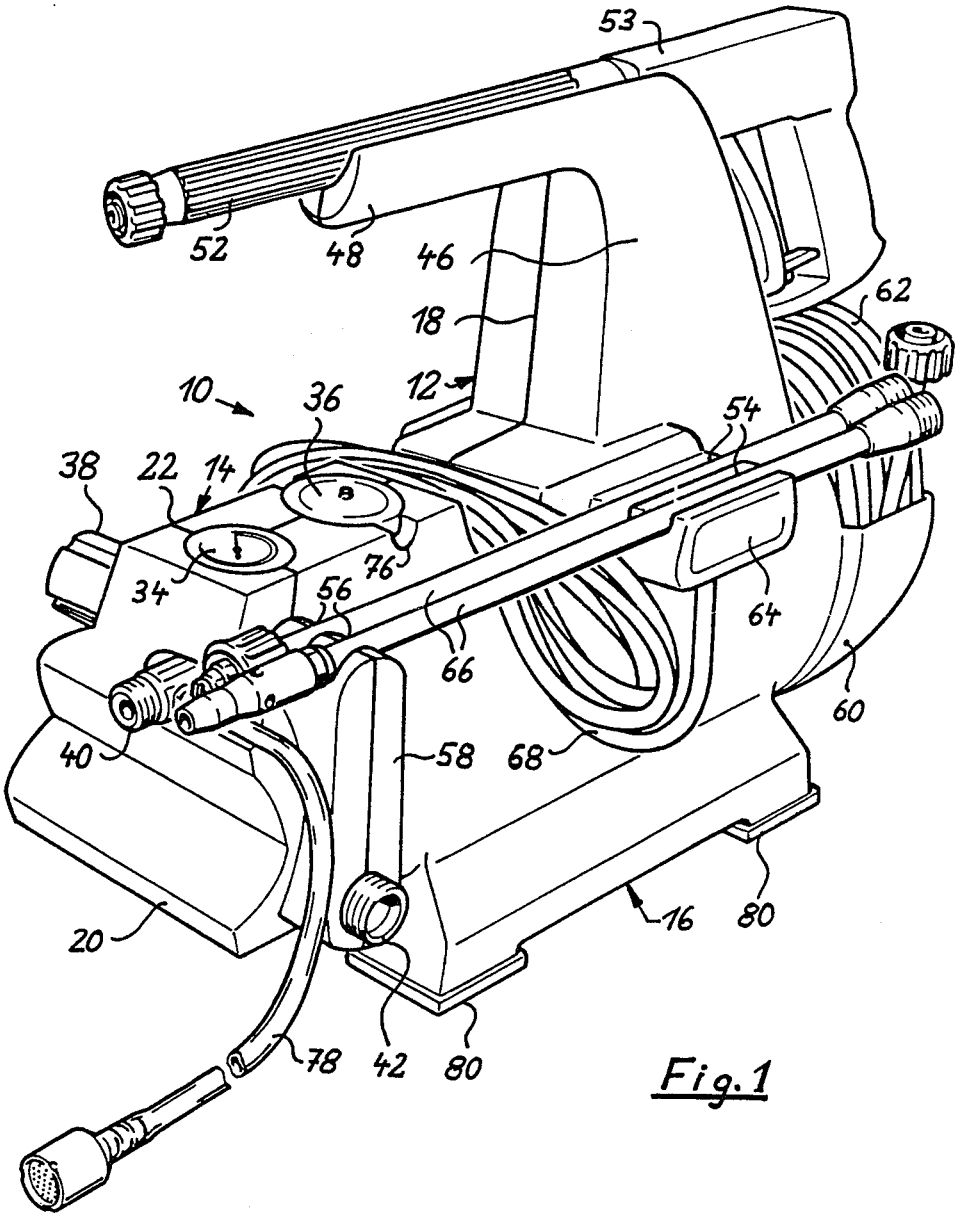
FIG. 1 is a perspective view of the embodiment of the pump unit according to the invention.

The figures show a pump unit 10 provided with a housing 12 preferably made of synthetic material. The housing 12 comprises two housing halves 14 and 16 as well as a front end part 20, these elements being connected along their engaging edges 18 and 22, respectively, by means of fixing elements (not shown), opposingly provided at the interior surfaces of the housing halves 14 and 16 and the front end part 20.

Figure 2:
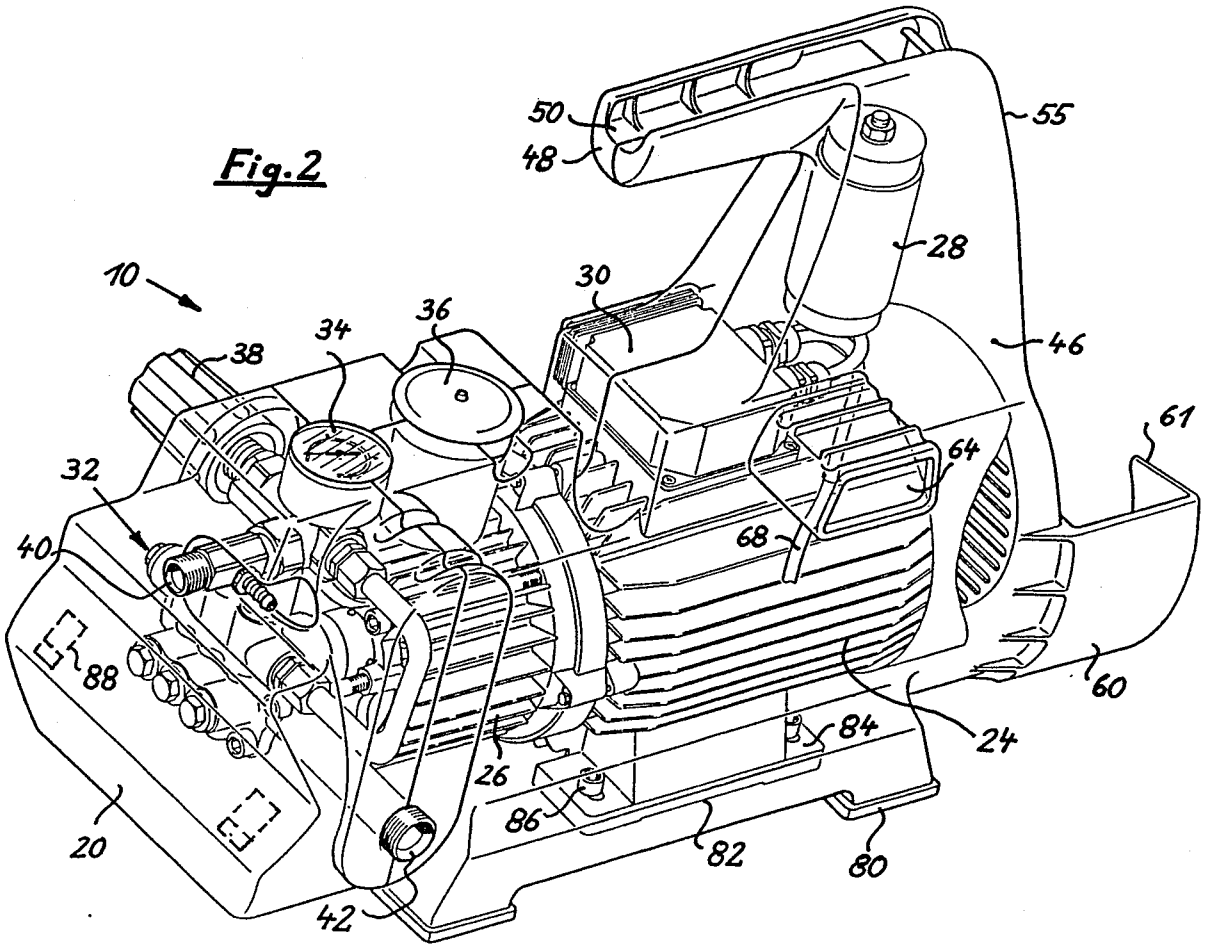
FIG. 2 is a perspective view similar to that of FIG. 1, illustrating the interior of the housing.

As shown in FIG. 2, the housing 12 surrounds a motor 24 having a pump 26 flanged thereto, an electrical connection and switch box 30 for the motor 24, a capacitor 28, and fitting elements generally designated by the numeral 32.

Furthermore, housing 12 also permits sight to a manometer 34, and access to a cover of a lubricant container 36, a handle 38 for a control valve, an outlet connection 40 and an inlet connection 42. A washing agent supply 78 may be connected at the outlet connection 40.

According to the invention, the housing 12 is formed such that it closely follows the contours of the elements housed therein and is provided with means to accommodate and hold various accessories used in operating the pump unit. Specifically, in the region above the electric motor 24 the combined housing halves 14 and 16 are provided with an upward projection 46 ending in an handle 48 which extends essentially in parallel to the longitudinal axis of the pump unit 10. The lower side of the handle 48 is adapted to the human hand by having a semi-cylindrical outer wall. At its upper side the handle 48 is provided with an essentially semi-cylindrical recess 60 for accommodating an outlet tube 52 of a washing pistol 53. At the rear 55 of handle 48, upward projection 46 is provided with a recess (not shown) for accommodating a trigger element of the washing pistol. The designs and sizes of the various recesses are selected such that there is a certain clamping effect on the washing pistol 53 and its tube 52 when placed in the recesses.

At the rear end side, the two housing halves 14 and 16 are shaped to form thereat a semi-circular drum 60, provided with an inwardly extending rim 61 and open in upward direction for accommodating a hose roll 62 (FIG. 1).

It should be noted that the projection 46 encloses the relatively voluminous capacitor 28, which otherwise, i.e. without a housing, is difficult to attach to the exterior of the motor 24 and may easily be damaged.

As shown in FIGS. 1 and 2, the housing half 16 of this embodiment is provided in the region of the connection and switch box 30 with a sideward projection 64 having one or two recesses 54 formed at its upper side. Similarly, the front end part 20 is provided with a sideward projection 58 having formed two recesses 56 parallel to each other at its upper side. The recesses 54 and 56 are aligned and sized such that usual nozzle pipes 66 may be clamped therein.

An electrical supply cable 68 passes out of the housing 10 at the lower side of the sideward projection 64 and may be accommodated in folded form in a lateral recess 72 provided at the upper side of the housing halves 14 and 16 in the region between the connection and switch box 30 and the lubricant container 36. It should be noted that opening of the cover of the lubricant container 36 is facilitated by a recess 76 formed at the upper side of the housing halve 16 in parallel to the recess 72.

The lower parts of the housing halves 14 and 16 form a stable base 82 resting on plates 80, which results in stable positioning of the pump unit 10 positioning within the housing. This stability is further improved by rigid connection of a motor base 84 of the base 82 by fixing means such as screws 86.

In the interior of the front end part 20 spaced fixing elements, such as springs 88, may be provided for clamping a tool (not shown) such as a screwspanner.

In operation, the pump unit 10 as hitherto described is gripped at the handle 48 and carried to the operational site. It should be noted that the handle 48 in longitudinal direction is located such that the pump unit 10 is essentially balanced when carried thereby.

The washing pistol 53 is then removed from the handle 48 and the hose roll 62 is screwed onto the outlet connection 40. The other end of the hose roll 62 either has been connected to the washing pistol 53 or is now connected thereto now. Next, the desired nozzle pipe 66 is fixed to the outlet tube 52 of the washing pistol 53. Finally, the connector of the electrical cable 68 is plugged to an electrical supply socket (not shown). A water supply (not shown) is connected via a hose to the inlet connection 42.

Motor 24 is then energized by pressing a key switch (not shown) provided on a small control panel arranged in proximity of the valve 38. Thus, the pump unit 10 operates until the key switch is pressed again. After completion of the operation the hose is rolled up to the hose roll 62 and put into the drum 60. Furthermore, the nozzle pipe 66 is detached from the washing pistol 53 and clamped in the recess 54 and 56. The electrical connector is removed from its socket and the cable 68 is folded in order to fit into the recess 72. After inserting the washing pistol 63 into handle 48 the pump unit 10 is ready for transport to another site.

With the embodiment as described above, the housing 12 comprises two housing halves 14 and 16 and a front end part 20. In principle, the front end part could be integrated into the two housing halves. The design explained above has the advantage that the various projecting elements of the pump unit may be enclosed in a simple manner.

It should be noted that the housing of the invention closely follows the outer contours of the pump unit, resulting in a considerable reduction of space and facilitating the carrying of the pumping unit and assorted accessories. As regards the latter aspect, arranging the handle essentially above the centre of gravity of the pumping unit is a further improvement.

I claim:

1. A portable high-pressure pump unit including an electric motor and a pump block flanged to an end side of said motor and provided with an inlet duct, an outlet duct, at least one indicating device and manually operable setting means for controlling pump operation, comprising:

a unitary housing formed of synthetic material, enclosing both said electric motor and said pump block, provided with openings for access to said inlet and outlet ducts and passing said manually operable setting means therethrough and giving sight to said indicating device, the shape of said unitary housing closely following the outer contours of the pump unit, with a groove-like recess formed in said housing, in a direction lateral to a longitudinal axis of said pump unit, in a region between said electric motor and said pump block at an upper side of said housing for receiving electric cable therein;

a substantially horizontal forwardly extending handle integrally formed at an upwardly projecting part at a rear end portion of said unitary housing;

laterally extending projections integral with said unitary housing for accommodating accessories necessary for an operation of said pump unit;

a stable base support integrally formed with said unitary housing; and a semi-cylindrical box opening upward and formed to be integral with said housing at a lower rear end portion thereof for receiving and accommodating a hose roll therein.

2. The pump unit of claim 1, further comprising:

a capacitor connected to said electric motor, wherein said upwardly projecting part of said housing is formed to enclose said capacitor.

3. The pump unit of claim 1, wherein:

a lower side of said handle is rounded and an upper side handle is provided with a semi-cylindrical longitudinal recess having upper parallel edges separated by a distance adapted to clamp a cylindrical accessory element.

4. The pump unit of claim 1, wherein:

said projections are provided at lateral distances from a main body portion of said housing in longitudinal alignment and spaced relationship adapted for holding nozzle pipes.

5. The pump unit of claim 1, wherein:

said housing comprises two housing halves that connect with each other at respective edges by connecting means.

6. The pump unit of claim 1, wherein:

said housing also comprises a laterally extending cover element closing to front ends of said two connected housing halves.

7. The pump unit of claim 5, wherein:

each of said two housing halves is provided with a base part for fixedly supporting said electric motor mounted thereto within said housing.

8. The pump unit of claim 1, wherein:

said two housing halves are made of synthetic material.

9. The pump unit of claim 5, wherein:

the two housing halves are fitted together by fixing means in a vertical plane containing a longitudinal axis of said pump unit, said housing halves being cast of synthetic material and an upward projection of each housing half being provided with an integrally formed handle part extending horizontally in longitudinal direction of said pump unit, said housing halves also being formed to a shape closely following the outer contours of said pump unit contained within the housing.

10. The pump unit of claim 9, further comprising:

a laterally extending cover element formed to close respective front ends of said two fitted housing valves.

11. The pump unit of claim 9, wherein:

each of said housing halves is provided with a base part for fixedly supporting said electric motor mounted thereto within said housing.

12. The pump unit of claim 9, wherein:

said housing is formed to integrally provide a semicircular drum-like box for accommodating an accessory hose roll therein.

* * * * *